US008707722B2

(12) United States Patent
Kim

(10) Patent No.: US 8,707,722 B2
(45) Date of Patent: Apr. 29, 2014

(54) HEAT EXCHANGER

(75) Inventor: Jae Hoon Kim, Chungnam (KR)

(73) Assignee: KB Autotech Co., Ltd. (KR)

( * ) Notice: Subject to any disclaimer, the term of this patent is extended or adjusted under 35 U.S.C. 154(b) by 810 days.

(21) Appl. No.: 12/519,055

(22) PCT Filed: Dec. 7, 2007

(86) PCT No.: PCT/KR2007/006348

§ 371 (c)(1),
(2), (4) Date: Nov. 4, 2009

(87) PCT Pub. No.: WO2008/072859

PCT Pub. Date: Jun. 19, 2008

(65) Prior Publication Data

US 2010/0078159 A1 Apr. 1, 2010

(30) Foreign Application Priority Data

Dec. 14, 2006 (KR) ..... 10-2006-0128193

(51) Int. Cl.
*F25D 21/14* (2006.01)

(52) U.S. Cl.
USPC ..... 62/291; 62/290; 62/288; 62/286

(58) Field of Classification Search
USPC ..... 62/290, 291, 288, 286
See application file for complete search history.

(56) References Cited

U.S. PATENT DOCUMENTS

| | | | | |
|---|---|---|---|---|
| 3,750,418 | A * | 8/1973 | Maudlin | 62/290 |
| 4,461,348 | A * | 7/1984 | Toge et al. | 165/173 |
| 5,800,673 | A * | 9/1998 | Okuda et al. | 159/28.6 |
| 5,947,196 | A * | 9/1999 | Halm et al. | 165/173 |
| 6,308,527 | B1 * | 10/2001 | Kuroyanagi et al. | 62/288 |
| 2005/0034471 | A1 * | 2/2005 | Shin | 62/285 |
| 2006/0086486 | A1 * | 4/2006 | Sudo | 165/143 |
| 2007/0251681 | A1 * | 11/2007 | Higashiyama et al. | 165/153 |

FOREIGN PATENT DOCUMENTS

| | | |
|---|---|---|
| JP | 58-162471 | 10/1983 |
| WO | 2006/070918 | 7/2006 |

* cited by examiner

*Primary Examiner* — Brandon M Rosati
*Assistant Examiner* — Dawit Muluneh
(74) *Attorney, Agent, or Firm* — Michael Best & Friedrich LLP

(57) ABSTRACT

A heat exchanger, having a unit for draining condensed water collected in a lower portion of a heat exchanger core, is provided. The heat exchanger includes an upper header tank and a lower header tank; a plurality of tubes communicating with both the upper header tank and the lower header tank; a plurality of fins provided between neighboring tubes; and a plurality of condensed water drain units provided with respective fitting parts closely fitted onto ends of the tubes, wherein the condensed water drain units drain condensed water, collected in a space defined by the lower header tank, the tubes and the fins.

18 Claims, 3 Drawing Sheets

HEAT EXCHANGER

CROSS-REFERENCE TO RELATED APPLICATIONS

This patent application is a national stage filing under 35 U.S.C. 371 of International Application No. PCT/KR2007/006348, filed 7 Dec. 2007, and claims priority to Korean Patent Application No. 10-2006-0128193, filed 14 Dec. 2006, the entire contents of which are incorporated herein by reference.

TECHNICAL FIELD

The present invention relates, in general, to heat exchangers and, more particularly, to a heat exchanger having a unit for draining condensed water collected in a lower portion of a heat exchanger core.

BACKGROUND ART

A heat exchanger is a device for transmitting heat from a high temperature fluid to a low temperature fluid through a heat transfer wall, and is typically used in heaters, coolers, evaporators or condensers. Hereinbelow, an evaporator equipped with a heat exchanger will be described in detail.

An evaporator constitutes a refrigeration system (not shown) and works together with a compressor, a condenser and an expansion valve in the refrigeration system. In the operation of a refrigeration system, a low temperature and low pressure gas refrigerant from an evaporator is compressed by a compressor, thus becoming a compressed gas refrigerant having a high temperature and a high pressure. The high temperature and high pressure gas refrigerant flows into a condenser, in which the gas refrigerant is cooled by atmospheric air, thus becoming a low temperature and high pressure liquid refrigerant. The liquid refrigerant flows from the condenser into an expansion valve, in which the liquid refrigerant passes through small-sized holes so that the pressure and temperature of the liquid refrigerant are reduced. Thus, the low temperature and high pressure liquid refrigerant becomes a low temperature and low pressure liquid refrigerant in the expansion valve. Thereafter, the low temperature and low pressure liquid refrigerant flows through evaporation tubes of the evaporator and absorbs heat from the area surrounding the tubes, thus evaporating in the tubes so as to become a low temperature and low pressure gas refrigerant.

When hot room air is blown into the gaps between the low temperature refrigeration tubes of the evaporator by a blower during the above-mentioned process, heat is transferred from the air to the tubes, so that the air becomes cool air. Thus, the refrigeration system can cool the room by supplying the cool air into the room.

As shown in FIG. 1 and FIG. 2, a conventional evaporator comprises a core 10 with two connection pipes 70 connected at respective ends thereof to the core 10. The core 10 comprises an upper header tank 50 made of a longitudinal pipe having a large-sized cross-section, a lower header tank 20 having the same shape as the upper header tank 50 and placed beneath the upper header tank 50 such that they are parallel to each other, and a plurality of tubes 60 communicating with the upper header tank 50 at first ends thereof and with the lower header tank 20 at second ends thereof. Further, a plurality of corrugated fins 30 is continuously placed from the upper header tank 50 to the lower header tank 20 at locations between neighboring tubes 60.

During operation, the conventional evaporator having the above-mentioned construction absorbs a large amount of heat from the surroundings and the temperature of the surface of the core 10 is maintained at a point lower than that of the surroundings, so that the vapor around the core 10 is condensed on the surface of the core 10, thus forming condensed water. The condensed water formed on the surface of the core 10 is dropped downwards into a drain tray after passing by the lower header tank 20 due to gravity.

However, the evaporator having the above-mentioned construction is problematic as follows. When the evaporator stops operation, the condensed water cannot be completely drained downwards from the lower header tank 20, but some of the condensed water remains in a condensed water collection space 40, defined between the lower ends of the tubes 60, the fins 30 and the lower header tank 20, because the surface tension acting on the condensed water in the condensed water collection space 40 is greater than the force of gravity acting on the condensed water. In the above state, mold or germs may inhabit the condensed water remaining in the condensed water collection space 40, thus having an ill effect on the health of users and contributing to a reduction in the durability of the evaporator.

DISCLOSURE OF INVENTION

Technical Problem

Accordingly, the present invention has been made keeping in mind the above problems occurring in the related art, and is intended to provide a heat exchanger, in which a condensed water drain assembly is provided so as to drain remaining condensed water, collected in a condensed water collection space, outside a refrigeration system, thus preventing both the dispersion of condensed water and the freezing of a heat exchanger core, and realizing improved durability and cleanliness of the heat exchanger.

Technical Solution

In an aspect, the present invention provides a heat exchanger, comprising: an upper header tank and a lower header tank; a plurality of tubes communicating with both the upper header tank and the lower header tank; a plurality of fins provided between neighboring tubes; and a plurality of condensed water drain units provided with respective fitting parts closely fitted onto ends of the tubes, wherein the condensed water drain units drain condensed water, collected in a space defined by the lower header tank, the tubes and the fins.

In the heat exchanger, the condensed water drain units may be provided to correspond to respective tubes. Alternatively, the condensed water drain units may be provided so as to alternate with the tubes. Further, each of the condensed water drain units may be provided with a protrusion rib, which extends downwards from an associated fitting part and is in contact both with part of an upper surface and with a front surface of the lower header tank.

Further, each of the condensed water drain units may be provided with an extension part, which extends from an associated fitting part along the lower header tank. Each of the fitting parts may have a depth greater than a thickness of an associated tube. Each of the fitting parts may be provided with a locking part, which is locked to an associated tube.

In the heat exchanger, the protrusion rib may have a rounded shape in a contact part thereof, which is in contact with the lower header tank. Further, the protrusion rib may extend to protrude beyond the extension part, which extends from the fitting part along the lower header tank.

In another aspect, the present invention provides a heat exchanger, comprising: an upper header tank and a lower header tank; a plurality of tubes communicating with both the upper header tank and the lower header tank; a plurality of fins provided between neighboring tubes; and a condensed water drain assembly, comprising: a plurality of condensed water drain units provided with respective fitting parts closely fitted onto ends of the tubes; and a connector provided between neighboring condensed water drain units, wherein the condensed water drain assembly drains condensed water collected in a space defined by the lower header tank, the tubes and the fins.

In the heat exchanger, the condensed water drain units may be provided to correspond to respective tubes. Alternatively, the condensed water drain units may be provided to alternate with the tubes. Further, a plurality of condensed water drain assemblies may be provided in the heat exchanger. Some of the plurality of fitting parts may be long fixed fitting parts.

Further, each of the condensed water drain units may be provided with a protrusion rib, which extends downwards from an associated fitting part and is in contact both with part of an upper surface and with a front surface of the lower header tank. Each of the condensed water drain units may be provided with an extension part, which extends from an associated fitting part along the lower header tank. Further, some or all of the plurality of protrusion ribs may be extended protrusion ribs, which extend downwards a long distance.

Each of the fitting parts may have a depth greater than a thickness of an associated tube. The protrusion rib may have a rounded shape in a contact part thereof, which is in contact with the lower header tank. Further, each of the fixed fitting parts may be provided with a locking part, which is locked to an associated tube.

Advantageous Effects

According to the present invention, condensed water, collected in a space defined between the lower ends of tubes, fins and the upper end of a lower header tank in a lower portion of a heat exchanger core, can be quickly and efficiently drained, thus realizing desired hygienic conditions and improved durability of the heat exchanger core.

Further, in the present invention, the tubes are deeply inserted into the fixed fitting parts, so that the condensed water drain assembly can be efficiently fastened to the tubes. Further, the extended protrusion ribs function to collect thereon condensed water, remaining in a space between the neighboring protrusion ribs, the lower header tank and a connector, prior to draining the condensed water to the outside.

MODE FOR THE INVENTION

Figure 1:
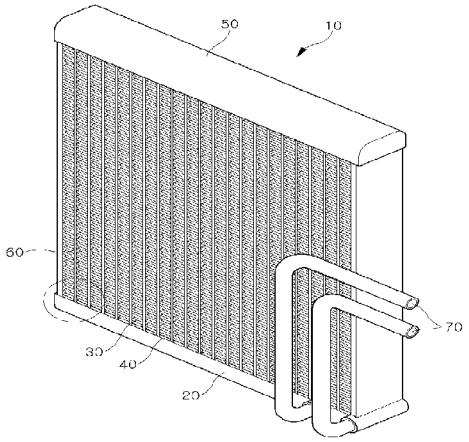
Fig. 1 Prior Art
FIG. 1 is a view illustrating a conventional heat exchanger.
Figure 2:
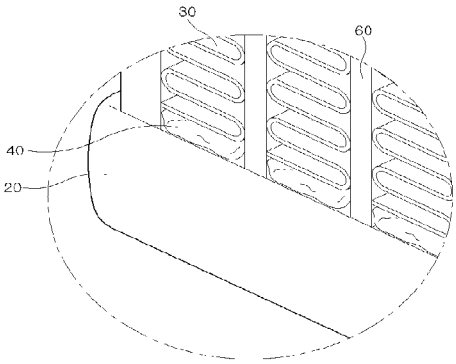
Fig. 2 Prior Art
FIG. 2 is a view illustrating condensed water collected in a lower space of the heat exchanger of FIG. 1.

Hereinbelow, preferred embodiments of the present invention will be described in detail with reference to the accompanying drawings. In the following description, it is to be noted that, wherever possible, the same reference numerals will be used throughout the drawings and the description to refer to the same or like parts. Further, when the functions of conventional elements and the detailed description of elements related with the present invention may make aspects of the present invention unclear, a detailed description of those elements will be omitted.

Figure 3:
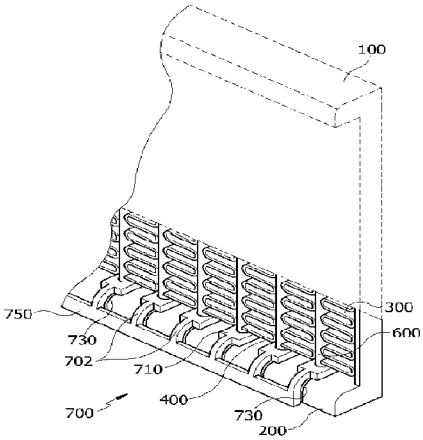
FIG. 3 is a view illustrating a heat exchanger equipped with a condensed water drain assembly according to the present invention.
Figure 4:
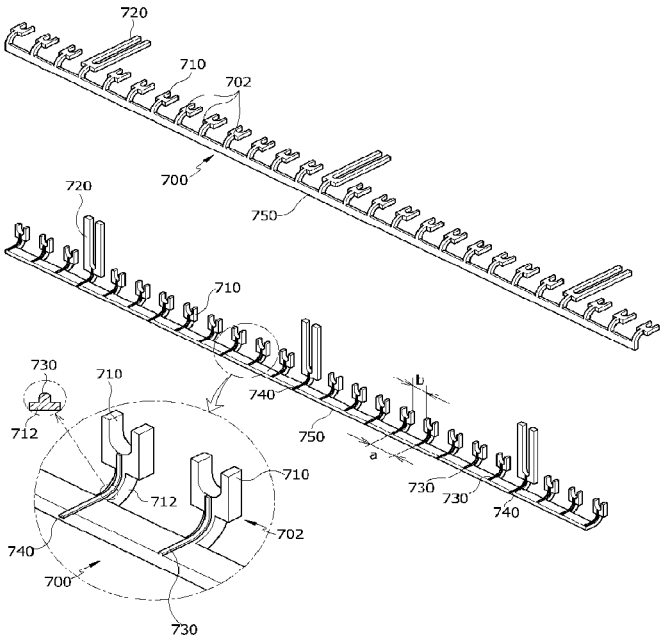
FIG. 4 is a perspective view of the condensed water drain assembly of FIG. 3.

FIG. 3 is a view of a heat exchanger equipped with a condensed water drain assembly according to the present invention. FIG. 4 is a perspective view of the condensed water drain assembly of FIG. 3.

Hereinbelow, an evaporator using the heat exchanger according to the present invention will be described as an example. The evaporator includes a condensed water drain assembly 700, which comprises an upper header tank 100, a lower header tank 200, a plurality of tubes 600 communicating with both the upper header tank 100 and the lower header tank 200, a plurality of fins 300 provided between the neighboring tubes 600, a plurality of condensed water drain units 702 provided with respective fitting parts 710 closely fitted onto the ends of the tubes 600, and a connector 750 provided between neighboring condensed water drain units 702.

In the present invention, a plurality of condensed water drain assemblies 700 may be provided. The condensed water drain assembly 700 functions to drain condensed water, collected in a space defined between the lower header tank 200, the tubes 600 and the fins 300, to the outside.

Figure 5:
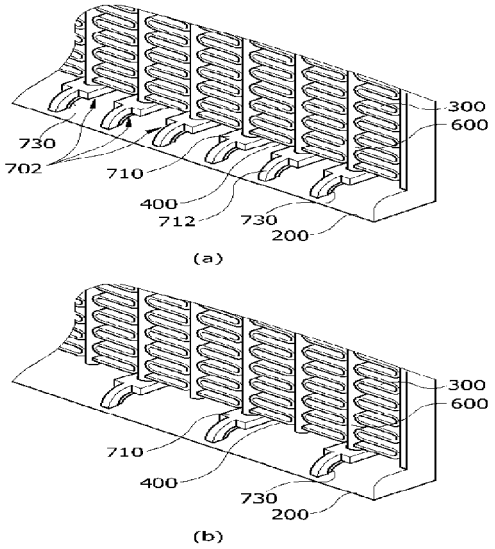
FIG. 5 is a perspective view of a heat exchanger equipped with a plurality of condensed water drain units according to the present invention.
Figure 6:
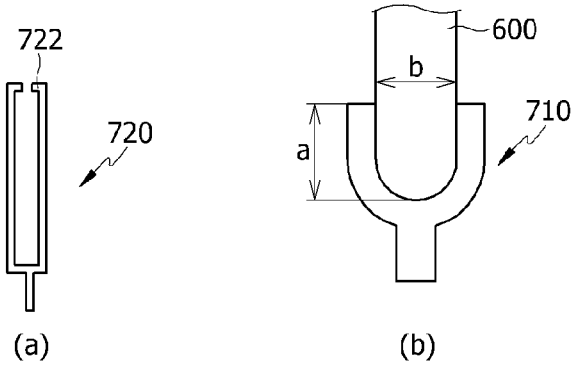
FIG. 6 is a view schematically illustrating some of the condensed water drain units of FIG. 5.
Figure 7:
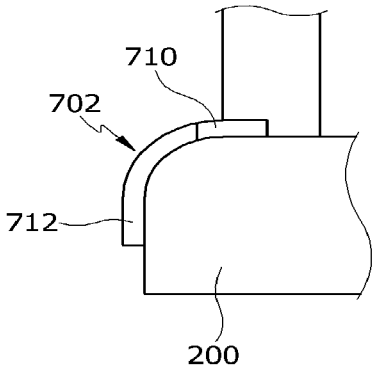
FIG. 7 is a sectional view of a heat exchanger equipped with a condensed water drain unit, made by removing a protrusion rib from the condensed water drain unit of FIG. 5.

FIG. 5 is a perspective view of a heat exchanger equipped with a plurality of condensed water drain units according to the present invention. FIG. 6 is a view schematically illustrating some of the condensed water drain units of FIG. 5. FIG. 7 is a sectional view of a heat exchanger equipped with a condensed water drain unit, the result of removing a protrusion rib from the condensed water drain unit of FIG. 5.

Further, the condensed water drain units 702, constituting the condensed water drain assembly 700, may be provided to correspond to respective tubes 600, or may be provided so as to alternate with the tubes 600. The condensed water drain units 702 may be configured as separate units provided to respective tubes 600, as shown in FIG. 5(*a*), or may be provided so as to alternate with the tubes 600, as shown in FIG. 5(*b*).

As shown in FIG. 4, some of the plurality of fitting parts 710 are long fixed fitting parts 720.

Further, each of the condensed water drain units 702 is provided with a protrusion rib 730, which extends downwards from an associated fitting part 710 and is in contact both with part of the upper surface and with the front surface of the lower header tank 200.

Further, as shown in FIG. 4, each of the protrusion ribs 730 has a rounded shape in a contact part thereof, which is in contact with the lower header tank 200. Further, some or all of the plurality of protrusion ribs 730 are extended protrusion ribs 740, which extend downwards a long distance.

As shown in FIG. 6(*a*), each of the fixed fitting parts 720 is provided with a locking part 722, which is locked to an associated tube 600. As shown in FIG. 6(*b*), each of the fitting parts 710 has a depth 'a' which is greater than the thickness 'b' of an associated tube 600.

As shown in FIG. 6(*a*), each of the fixed fitting parts 720 is provided with a locking part 722, which is locked to an associated tube 600. As shown in FIG. 6(*b*), each of the fitting parts 710 has a depth "a" which is greater than the thickness "b" of an associated tube 600.

Further, the height of the fitting parts 710 is less than the height from the upper surface of the lower header tank 200 to the fins 300 near the lower header tank 200.

In the present invention, the condensed water drain assembly 700, made of a material including an injection-moldable plastic material, is preferably placed such that it is opposed to the air blowing direction toward the evaporator. However, it should be understood that the condensed water drain assembly 700 may be fastened either to the lower front part or to the lower rear part of the heat exchanger or may be fastened to both the front and rear parts of the heat exchanger, as required.

Each of the condensed water drain units 702 may be configured to have only the extension part 712, extending from the fitting part 710 to the lower header tank 200, without having the protrusion rib 730.

Hereinbelow, the operation of a refrigeration system having an evaporator as the heat exchanger equipped with the above-mentioned condensed water drain assembly according to the present invention will be described.

When an operator operates the refrigeration system after installing the condensed water drain assembly 700 in the evaporator, as shown in FIG. 3, or installing the condensed water drain units 702 in the evaporator, as shown in FIG. 5, the evaporator is operated as an element of the refrigeration system (not shown) in cooperation with a compressor, a condenser and an expansion valve.

In the above state, liquid refrigerant, input into the evaporator through an input connection pipe, flows into the tubes 600 through the lower header tank 200. When the liquid refrigerant flows through the tubes 600, the refrigerant absorbs heat from the area surrounding the tubes 600 while evaporating in the tubes 600. Thus, the surfaces of the tubes 600 are cooled, so that the vapor around the tubes 600 condenses on the surfaces of the tubes 600. Therefore, condensed water is formed on the surfaces of the tubes 600 and is drained downwards due to gravity.

When the evaporator is continuously operated, the condensed water is continuously formed and is continuously drained downwards from the lower header tank 200. However, when the evaporator stops operating, the formation of condensed water stops and some of the condensed water remains in the condensed water collection space 400.

In the above state, it is desirable to drain all of the remaining condensed water downwards due to gravity. However, some of the condensed water remains in the condensed water collection space 400, because the surface tension, which is the attractive force acting on the condensed water in the condensed water collection space 400, is greater than the force of gravity acting on the condensed water.

Here, the surface tension acting between the fitting parts 710 and the condensed water is greater than the surface tension acting between the condensed water collection space 400 and the condensed water, so that the condensed water, collected in the condensed water collection space 400, flows into the space between the fitting parts 710.

Here, in the present invention, the interval between the neighboring protrusion ribs 730 is greater than the interval between the neighboring fitting parts 710, so that the surface tension acting between the neighboring protrusion ribs 730 is less than the surface tension acting between the neighboring fitting parts 710. Thus, the inlet condensed water flows into the space defined between the protrusion ribs 730, the lower header tank 200 and the connector 750, and is then drained downwards due to gravity.

Further, the tubes 600 are deeply inserted into the fixed fitting parts 720, so that the condensed water drain assembly 700 can be efficiently fastened to the tubes 600.

Further, because the extended protrusion ribs 740 are located in the lowermost position in the condensed water drain assembly 700, the condensed water, remaining in the space defined between the neighboring protrusion ribs 730, the lower header tank 200 and the connector 750, is collected on the extended protrusion rib 740 prior to being drained to the outside.

Therefore, the present invention further improves the condensed water draining effects due to the extended protrusion ribs 740.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A heat exchanger, comprising:

an upper header tank and a lower header tank, the lower header tank including an uppermost portion that defines a plurality of openings;

a plurality of tubes communicating with both the upper header tank and the lower header tank, each tube received within a different one of the plurality of openings in the lower header tank;

a plurality of fins provided between neighboring tubes; and condensed water drain units provided with respective fitting parts closely fitted onto ends of the tubes, each condensed water drain unit is separate from and located atop the uppermost portion of the lower header tank to extend over the uppermost portion, wherein the condensed water drain units drain condensed water collected in a space defined by the lower header tank, the tubes and the fins, wherein each of the condensed water drain units is provided with a protrusion rib, which extends downwards from an associated fitting part and is in direct contact both with part of an upper surface and with a front surface of the lower header tank.

2. The heat exchanger according to claim 1, wherein each condensed water drain unit corresponds to one of the plurality of tubes.

3. The heat exchanger according to claim 2, wherein the condensed water drain units are provided so as to alternate with the tubes.

4. The heat exchanger according to claim 1, wherein each of the condensed water drain units is provided with an extension part, which extends from an associated fitting part along the lower header tank.

5. The heat exchanger according to claim 1, wherein each of the fitting parts has a depth greater than a thickness of an associated tube.

6. The heat exchanger according to claim 1, wherein each of the fitting parts is provided with a locking part, which is locked to an associated tube.

7. The heat exchanger according to claim 1, wherein the protrusion rib has a rounded shape in a contact part, which is in contact with the lower header tank.

8. The heat exchanger according to claim 1, wherein each of the condensed water drain units is provided with an extension part, and wherein the protrusion rib extends to protrude beyond the extension part, which extends from the fitting part along the lower header tank.

9. A heat exchanger, comprising:

an upper header tank and a lower header tank, the lower header tank including an uppermost portion that defines a plurality of openings;

a plurality of tubes communicating with both the upper header tank and the lower header tank, each tube received within a different one of the plurality of openings in the lower header tank;

a plurality of fins provided between neighboring tubes; and a condensed water drain assembly, comprising:

a plurality of condensed water drain units provided with respective fitting parts closely fitted onto ends of the tubes, each condensed water drain unit is separate from and located atop the uppermost portion of the lower header tank to extend over the uppermost portion; and a connector provided between neighboring condensed water drain units, wherein the condensed water drain assembly drains condensed water collected in a space defined by the lower header tank, the tubes and the fins, wherein each of the condensed water drain units is provided with a protrusion rib, which extends downwards from an associated fitting part and is in direct contact both with part of an upper surface and with a front surface of the lower header tank.

10. The heat exchanger according to claim 9, wherein each condensed water drain unit corresponds to one of the plurality of tubes.

11. The heat exchanger according to claim 9, comprising a plurality of condensed water drain assemblies.

12. The heat exchanger according to claim 10, wherein the condensed water drain units are provided to alternate with the tubes.

13. The heat exchanger according to claim 9, wherein some of the plurality of fitting parts are longer than other fixed fitting parts.

14. The heat exchanger according to claim 9, wherein each of the condensed water drain units is provided with an extension part, which extends from an associated fitting part along the lower header tank.

15. The heat exchanger according to claim 9, wherein each of the fitting parts has a depth greater than a thickness of an associated tube.

16. The heat exchanger according to claim 13, wherein each of the fixed fitting parts is provided with a locking part, which is locked to an associated tube.

17. The heat exchanger according to claim 10, wherein at least some of the plurality of protrusion ribs are extended protrusion ribs, which extend downwards a longer distance than other protrusion ribs.

18. The heat exchanger according to claim 10, wherein the protrusion rib has a rounded shape in a contact part, which is in contact with the lower header tank.

* * * * *

UNITED STATES PATENT AND TRADEMARK OFFICE

CERTIFICATE OF CORRECTION

PATENT NO. : 8,707,722 B2
APPLICATION NO. : 12/519055
DATED : April 29, 2014
INVENTOR(S) : Jae Hoon Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1099 days.

Signed and Sealed this
Twenty-ninth Day of September, 2015

Michelle K. Lee

Michelle K. Lee
*Director of the United States Patent and Trademark Office*